United States Patent [19]

Drori

[11] 4,351,503

[45] Sep. 28, 1982

[54] STABILIZED PROJECTILES

[76] Inventor: Mordeki Drori, 89 Zahal St., Kiron, Israel

[21] Appl. No.: 124,219

[22] Filed: Feb. 25, 1980

Related U.S. Application Data

[63] Continuation of Ser. No. 650,045, Jan. 19, 1976, abandoned.

[51] Int. Cl.[3] ..... F42B 15/16

[52] U.S. Cl. ..... 244/3.24; 102/385; 244/3.21

[58] Field of Search ..... 244/321, 3.24–3.3; 102/384, 385, 400

[56] References Cited

U.S. PATENT DOCUMENTS

| | | | |
|---|---|---|---|
| 1,316,296 | 9/1919 | Gathmann | 244/3.27 |
| 2,380,278 | 7/1945 | Weissman | 102/386 |
| 2,433,234 | 12/1947 | McHugh | 102/400 |
| 2,494,026 | 1/1950 | Anderson | 244/3.24 |
| 2,752,850 | 7/1956 | Warner et al. | 244/3.26 |
| 3,195,462 | 7/1965 | Petre | 244/3.21 X |
| 3,196,794 | 7/1965 | Meade | 244/3.21 |
| 3,658,004 | 4/1972 | Blair | 244/3.23 |

*Primary Examiner*—Harold J. Tudor
*Attorney, Agent, or Firm*—Benjamin J. Barish

[57] ABSTRACT

Stabilized ballistic projectiles of the explosive type (e.g. artillery and mortar shells, bombs) are described including a plurality of stabilizing fins symmetrically arranged around the nose of the projectile well forward of its center of mass and pivotable on axes at right angles to the projectile axis, the leading edge of each fin, and the pivot axis of each fin, being located with respect to the foremost point of the projectile, inclusive of its stabilizing fins, a distance which is substantially less than the length of the fin.

8 Claims, 9 Drawing Figures

STABILIZED PROJECTILES

RELATED APPLICATION

This application is a continuation of my pending application Ser. No. 650,045 filed Jan. 19, 1976, to be abandoned with the filing of this application.

BACKGROUND OF THE INVENTION

The present invention relates to military projectiles, and particularly to new means for stabilizing military projectiles.

Several techniques are now used for stabilizing military projectiles, i.e., maintaining them "nose-on" during flight. Thus, there are spin-stabilized projectiles which are maintained "nose-on" by a rapid spin imparted to them by the rifling, or system of helical grooves, formed in the bore of the gun. There are also fin-stabilized projectiles which include a plurality of fins or vanes fixedly attached to the rear of the projectile, the air exerting a restoring force when the projectile axis departs from tangency to the trajectory. Fin-stabilized projectiles generally include airplane bombs and certain types of mortar projectiles, while the others, such as artillery shells, are usually spin-stabilized.

An object of the present invention is to provide new means for stabilizing projectiles.

SUMMARY OF THE INVENTION

According to a broad aspect of the invention, there is provided a ballistic projectile (e.g. artillery and mortar shells) including at least three stabilizing fins symmetrically arranged around the nose of the projectile well forward of its center of mass and pivotable on axes at right angles to the projectile axis, both the leading edge of each fin, and the pivot axis of each fin, being located with respect to the foremost point of the projectile, inclusive of its stabilizing fins, a distance which is substantially less than the length of the fin.

In the preferred embodiments of the invention described below, each of the stabilizing fins is independently pivotable on an axis extending radially of the projectile and intersecting the projectile axis at a right angle thereto, so as to be pivotable to one side or the other side of the projectile axis.

According to another feature of the invention, the stabilizing fins are carried by an annular ring attached to the nose of the projectile.

According to further features of the invention, the ring is of frustro-conical shape. Also, each pivotable fin is aerodynamically shaped and includes a forward nose portion and a rear tail portion of decreasing width, the pivotable mounting of the fin being closer to its forward nose portion than to its rear tail portion.

The new manner of stabilizing projectiles in accordance with the invention provides a number of advantages, particularly when used in the heretofore spin-stabilized applications, such as artillery shells. Thus, it obviates the need, and the considerable expense, of forming the riflings or helical groove in the gun bore. Also, since the pivotable fin assembly is attached to the nose end of the projectile, relatively simple attaching means can be used after the projectile has been manufactured, such as a press-fit or threaded mounting. Further, relatively inexpensive material can be used, probably even plastic. This manner of stabilizing may also increase the range of artillery missiles, since the energy for producing the spin is saved; also, the fins provide additional gliding surfaces upon descent of the projectile. The pivotable spin assembly would also appear to improve the accuracy of the projectile, since they would tend to correct for cross-winds and also would avoid "drift", i.e., the lateral displacement of spin-stabilized projectiles arising because of the gyroscopic action causing them to precess slowly in the direction of the spin.

Further features and advantages of the invention will be apparent from the description below.

BRIEF DESCRIPTION OF THE DRAWINGS

The invention is herein described, by way of example only, with reference to several preferred embodiments illustrated in the accompanying drawings, wherein.

DESCRIPTION OF THE PREFERRED EMBODIMENTS

Figure 2:
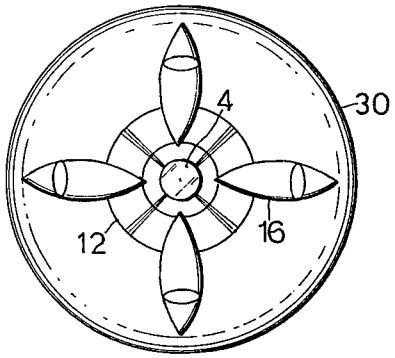
FIG. 2 is a front view of the artillery shell of FIG. 1.
Figure 1:
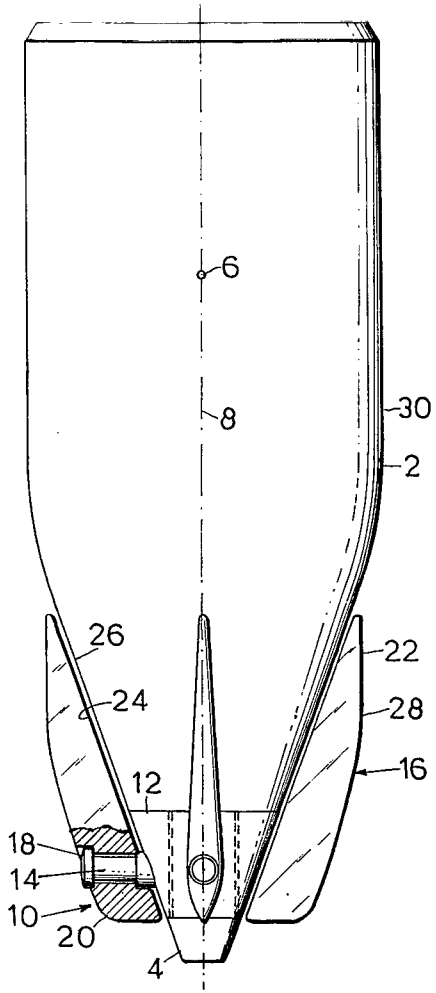
FIG. 1 is a side elevational view of an artillery shell fitted with a pivotable fin assembly in accordance with the invention.

With reference to FIGS. 1 and 2, there is shown a conventional artillery shell, generally designated 2, containing an explosive charge the nose 4 of which shell includes a conventional detonator. The centre of mass of the shell is indicated at 6 and is on the longitudinal axis 8 of the shell.

In accordance with the present invention, a pivotable fin assembly, generally designated 10, is mounted on the nose end of the projectile, preferably well forward of its centre of mass 6.

The pivotable fin assembly 10 comprises an annular ring 12 of frustro-conical shape. It includes a plurality of symmetrically-arranged equally-spaced pins 14 projecting radially outwardly of the ring and at right angles to its longitudinal axis, the latter being coaxial with the longitudinal axis 8 of the projectile. Pivotably mounted on each pin 14 is a fin or vane 16, the pin being formed with an enlarged head 18 for retaining the pivotable fin thereon.

Each fin 16 is aerodynamically shaped and includes a leading edge or front nose portion 20, and a trailing edge or rear tail portion 22 of decreasing width. As shown particularly in FIG. 1, the pivotal mounting of the fin on pin 14 is closer to the forward nose portion of the fin than to its rear tail portion. In addition, the leading edge 20 of each fin, and its pivot axis (pin 14), are both located with respect to the foremost point of the projectile, inclusive of its stabilizing fins, a distance which is substantially less than the length of the fin. The lower surface 24 of the fin conforms to the surface 26 of the projectile underlying it, and the upper surface 28 of the fin is curved so as to provide a stream-line continuation of the surface 30 of the projectile directly to the rear of the fin.

The pivotal fin assembly may be attached to the projectile in any suitable manner, such as by press-fitting ring 12 to the nose 4 of the projectile, or by threading it thereon.

As mentioned above, the pivotal fin assembly 10 effectively stabilizes the projectile without the need for imparting a spin to it. The invention therefore can be used with smooth-bore guns, which are considerably less expensive to produce than the rifle-bore guns heretofore required with spin-stabilized projectiles. In addition, the energy required to produce the spin is saved, thereby tending to increase the range of the projectile. A further factor tending to increase the range is that the pivotal fins increase the gliding surface of the projectile during its descent.

As also mentioned earlier, the pivotal fin assembly also tends to increase the accuracy of the projectile, since it avoids the "drift" arising by the gyroscopic action of a spin-stabilized projectile.

Since the pivotal fin assembly 10 is attached to the nose end of the projectile, it is not subjected to the hot explosive gases, and therefore may be made of inexpensive material, for example plastic. Further, it may be attached by simple means, as mentioned above, and at any convenient time, such as just before use.

Figure 3:
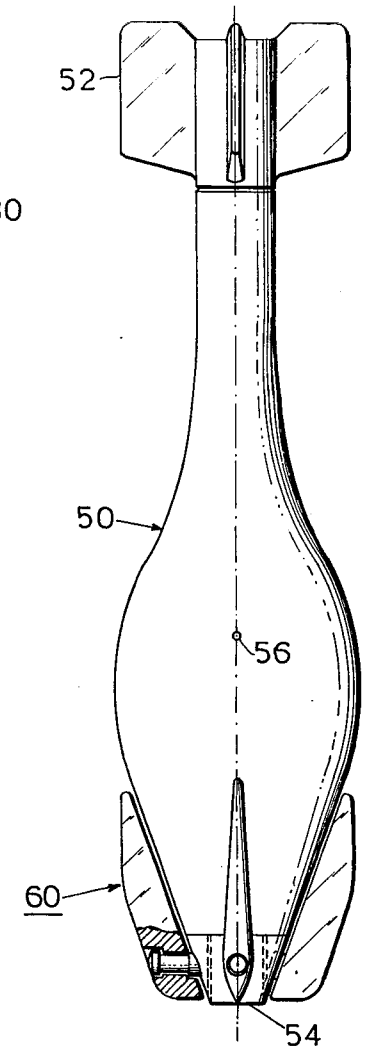
FIG. 3 is a side elevational view of a mortar shell fitted with a pivotable fin assembly in accordance with the invention.
Figure 4:
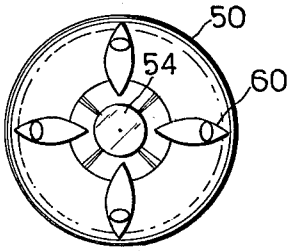
FIG. 4 is a front view of the mortar shell of FIG. 3.

FIGS. 3 and 4 illustrate the invention applied to a mortar shell, generally designated 50, the mortar shell including the conventional fixedly-attached rear fins 52. According to the invention, the pivotal fin assembly, generally designated 60 in FIGS. 3 and 4, is attached to the nose 54 of the mortar shell, well forward of its centre of mass 56. The pivotal fin assembly 60, when used in the mortar shell of FIGS. 3 and 4, is of the same construction as assembly 10 illustrated in FIGS. 1 and 2 used in the artillery shell.

The mortar shell 50 may or may not retain the conventional rear fixedly-attached stabilizing fins 52 illustrated in FIGS. 3 and 4. Even when the fixed fins are retained, the provision of the pivotal fin assembly 60 to its nose provides some advantage in increasing stabilization and also increasing range and accuracy.

It will be appreciated that the pivotal fin assembly of the present invention could also be used in airplane bombs and other forms of military projectiles, as well as in toy projectiles.

The expression "fins" used herein is meant to include not only the aerodynamically shaped fins illustrated, but also fins or vanes of other shapes, pivotably mounted to the projectile as and for the purposes set forth. In addition, stops could be provided on both sides of each fin for limiting their pivotal movement. Further, while four fins have been illustrated it will be appreciated that a larger number or a smaller number (viz. three) could be used. The pivotal axes of the fins can be in the same plane as the longitudinal axis of the projectile, as showm, or in laterally spaced planes.

FIGS. 5–9 illustrate further variations of the invention.

Figure 5:
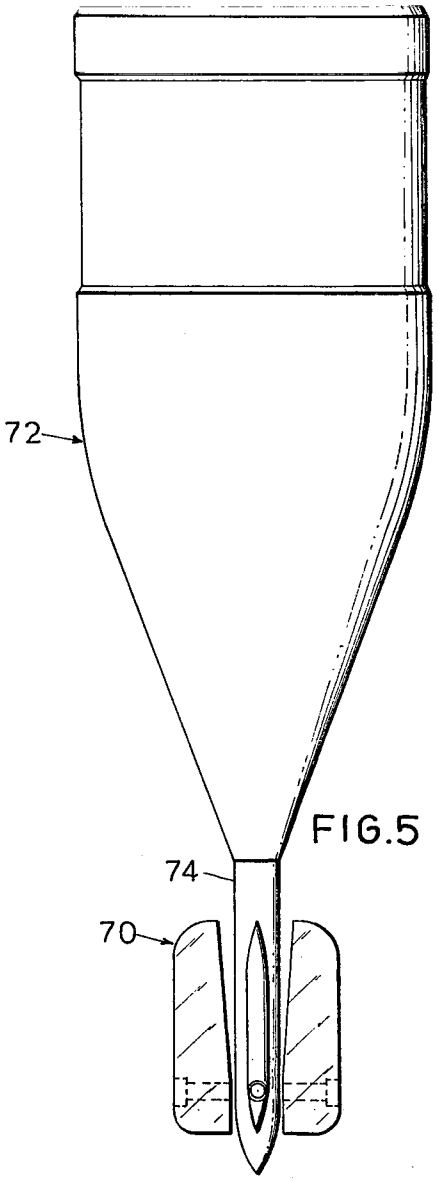
FIGS. 5–9 illustrate further variations of the invention.

Thus, FIG. 5 illustrates a pivotable fin assembly 70 attached to the nose of an artillery shell 72, the latter being applied with an elongated neck 74 of slightly larger length than the length of the fins in the assembly 70. In this case, as in FIGS. 1–3 described above, the leading edge of each fin, and the pivot axis of each fin, are both located with respect to the foremost point of the projectile, inclusive of its stabilizing fins, a distance which is substantially less than the length of the fin.

FIGS. 6–9 illustrate arrangements wherein the pivotable fin assembly is made as a single unit, the assembly being pivotably mounted as a unit to the projectile such that the leading edge of each fin and the pivot axis of each fin are also both located with respect to the foremost point of the projectile, inclusive of its stabilizing fins, a distance which is substantially less than the length of the fin for stabilizing the projectile. Such an assembly could be made of moulded plastic or cast metal at very low cost.

Figure 7:
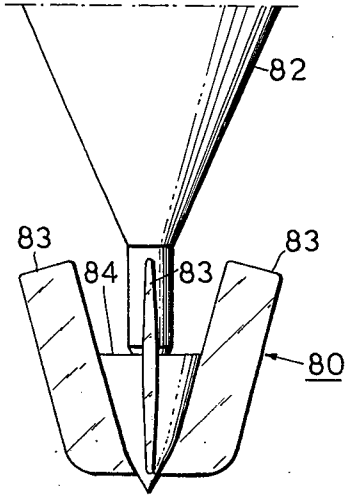
Figure 6:
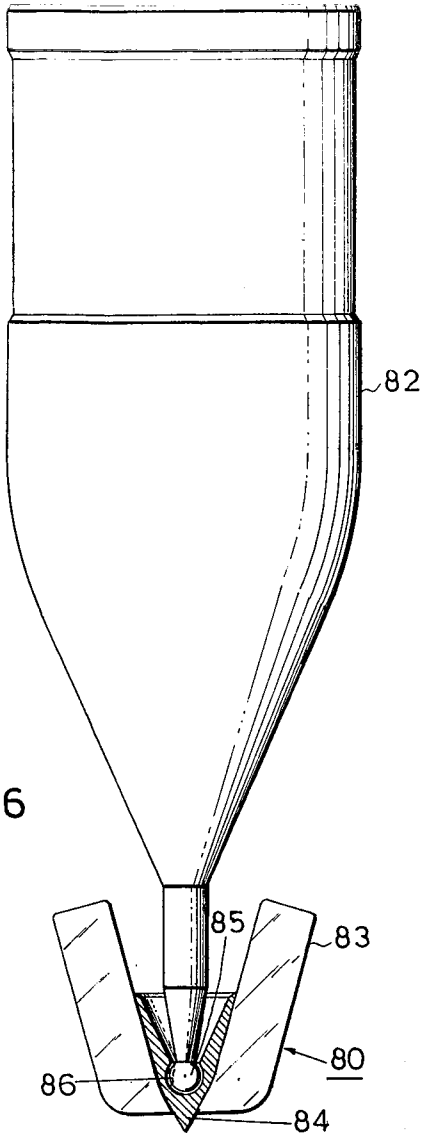

In FIGS. 6 and 7, the unitary fin assembly is indicated at 80, and is pivotably mounted as a unit to the nose of an artillery shell 82. The fins 83 are integrally secured to a web 84, the latter being pointed at its leading edge and flaring outwardly towards its trailing edge. For pivotably mounting the assembly, the nose of the shell 82 is formed with a ball 85, and the web 84 of the fin assembly 80 is formed with a spherical socket 86 pivotably receiving the ball. It will be seen that the whole assembly 80 may pivot on ball 85 for stabilizing the projectile.

Figure 8:
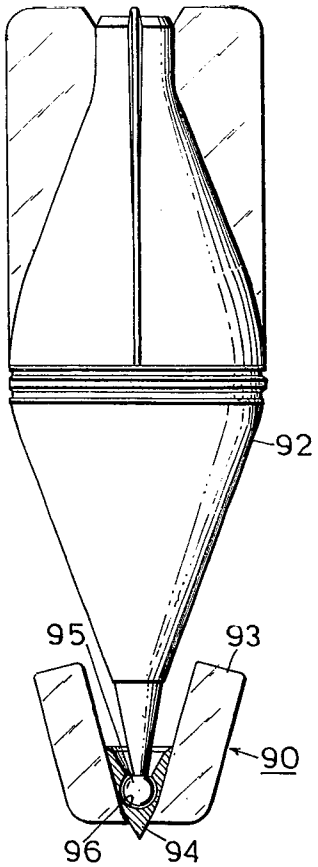
Figure 9:
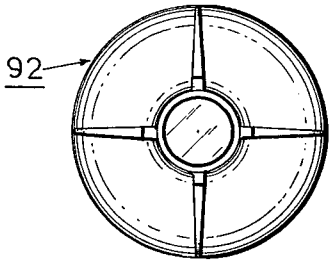

FIGS. 8 and 9 illustrate the unitary assembly 90 including the fins 93 applied to a mortar shell 92, the web 94 of the fin assembly being formed with a spherical socket 96 for receiving the ball 95 at the nose of the shell.

Further variations, modifications and applications of the illustrated embodiments will be apparent.

I claim:

1. A ballistic projectile characterized in that it includes at least three stabilizing fins symmetrically arranged around the nose of the projectile well forward of its center of mass, each of said fins being independently pivotable on an axis extending radially of the projectile and intersecting the projectile axis at a right angle thereto so as to be pivotable to one side or the other side of the projectile axis for stabilizing the projectile, the leading edge of each fin, and the pivot axis of each fin, being located with respect to the foremost point of the projectile, inclusive of its said fins, a distance which is substantially less than the length of the fin.

2. A projectile according to claim 1, wherein the projectile includes an explosive charge and a detonator at its nose.

3. A projectile according to claim 2, wherein the stabilizing fins are carried by an annular ring attached to the nose of the projectile.

4. A projectile according to claim 3, wherein the annular ring is attached by a press-fit to the nose of the projectile.

5. A projectile according to claim 3, wherein the annular ring is attached by threading to the nose of the projectile.

6. A projectile according to claim 3, wherein the annular ring includes a plurality of equally spaced pins projecting radially outwardly of the ring and at right angles to the longitudinal axis of the projectile.

7. A projectile according to claim 1, wherein each fin is aerodynamically shaped and includes a forward nose portion and a rear tail portion of decreasing width, the pivotable mounting of the fin being closer to its forward nose portion than to its rear tail portion.

8. A projectile according to claim 1, wherein the nose of the projectile includes an elongated neck of slightly larger length than the length of the fins.

* * * * *